US009371841B2

(12) United States Patent
Verma et al.

(10) Patent No.: US 9,371,841 B2
(45) Date of Patent: Jun. 21, 2016

(54) SAFETY ARRANGEMENT FOR AN INTEGRATED HEATER, PUMP, AND MOTOR FOR AN APPLIANCE

(75) Inventors: Ashish A. Verma, Winterville, NC (US); Dennis A. Poyner, Kinston, NC (US); Jerry Olesen, Kinston, NC (US); Ralph A. Porcaro, II, Clayton, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 569 days.

(21) Appl. No.: 13/411,778

(22) Filed: Mar. 5, 2012

(65) Prior Publication Data

US 2013/0230416 A1 Sep. 5, 2013

(51) Int. Cl.

| | |
|---|---|
| ***F04D 29/58*** | (2006.01) |
| ***A47L 15/42*** | (2006.01) |
| ***F04D 29/40*** | (2006.01) |

(52) U.S. Cl.

CPC ..... *F04D 29/5866* (2013.01); *A47L 15/4225* (2013.01); *A47L 15/4285* (2013.01); *F04D 29/406* (2013.01); *F04D 29/5893* (2013.01); *Y10T 29/49236* (2015.01)

(58) Field of Classification Search

CPC ..... F04D 1/00; F04D 7/00; H02K 5/10; F23M 9/10; F23M 11/02; Y10T 29/49236

USPC ..... 417/423.14, 423.9, 423.11

See application file for complete search history.

(56) References Cited

U.S. PATENT DOCUMENTS

| | | | | | |
|---|---|---|---|---|---|
| 2,965,318 | A | * | 12/1960 | Hans | E03C 1/2665 241/46.014 |
| 3,125,959 | A | * | 3/1964 | Stoddard et al. | 415/47 |
| 3,186,417 | A | | 6/1965 | Fay | |
| 3,286,712 | A | * | 11/1966 | Roden | A61H 33/6026 4/541.4 |
| 3,504,683 | A | | 4/1970 | Timmer et al. | |
| 3,711,681 | A | | 1/1973 | Leuschner et al. | |
| 4,443,187 | A | * | 4/1984 | Shaftner et al. | 432/222 |
| 4,558,205 | A | | 12/1985 | Bleckmann | |
| 4,992,690 | A | | 2/1991 | Baker | |
| 5,178,523 | A | * | 1/1993 | Cheng-Chung | 417/423.3 |

(Continued)

FOREIGN PATENT DOCUMENTS

| | | |
|---|---|---|
| DE | 3512659 | 10/1986 |
| DE | 3534754 | 4/1987 |

(Continued)

*Primary Examiner* — Justin Jonaitis

*Assistant Examiner* — Charles Nichols

(74) *Attorney, Agent, or Firm* — Alston & Bird LLP

(57) ABSTRACT

Systems, methods, and apparatuses for providing a safety arrangement for an integrated heater, circulation pump, and motor for an appliance are provided. In an example safety arrangement, the circulation pump assembly includes a heater, a pump, and a motor integrated into a single unit. The circulation pump assembly defines a first end, a second opposite end, and a housing extending therebetween. The safety arrangement includes a hub configured to at least partially surround the first end of the circulation pump assembly and a first shield configured to at least partially surround the housing of the circulation pump assembly. The safety arrangement further includes a second shield configured to at least partially surround the housing of the circulation pump assembly. The hub, the first shield, and the second shield are configured to cooperate with one another to protect the circulation pump assembly from one or more hazardous conditions.

18 Claims, 5 Drawing Sheets

(56) References Cited

U.S. PATENT DOCUMENTS

| | | | | |
|---|---|---|---|---|
| 5,470,142 | A | 11/1995 | Sargeant et al. | |
| 5,557,704 | A | 9/1996 | Dennis et al. | |
| 6,200,108 | B1 * | 3/2001 | Caudill et al. | 417/366 |
| 6,736,598 | B2 | 5/2004 | Kleemann et al. | |
| 7,287,536 | B2 | 10/2007 | Steck et al. | |
| 7,293,958 | B2 * | 11/2007 | Kraffzik | 415/206 |
| 7,455,065 | B2 * | 11/2008 | Schrott | 134/56 D |
| 7,496,284 | B2 | 2/2009 | Pleschinger et al. | |
| 7,538,301 | B2 | 5/2009 | Teufl et al. | |
| 7,560,672 | B2 | 7/2009 | Pleschinger et al. | |
| 7,669,591 | B2 | 3/2010 | Fossati et al. | |
| 7,796,868 | B2 | 9/2010 | Kaastra | |
| 7,870,863 | B2 | 1/2011 | Hedstrom et al. | |
| 8,245,718 | B2 * | 8/2012 | Busing et al. | 134/108 |
| 2004/0026411 | A1 | 2/2004 | Mucke et al. | |
| 2007/0228032 | A1 | 10/2007 | Reiter et al. | |
| 2007/0241100 | A1 | 10/2007 | Stickel | |
| 2008/0011341 | A1 | 1/2008 | Kim et al. | |
| 2008/0283094 | A1 | 11/2008 | Nagel et al. | |
| 2009/0060481 | A1 | 3/2009 | Kaastra | |
| 2009/0107988 | A1 | 4/2009 | Kaastra | |
| 2009/0272731 | A1 | 11/2009 | Olding et al. | |
| 2010/0119360 | A1 | 5/2010 | Bredl et al. | |
| 2010/0126534 | A1 | 5/2010 | Busing et al. | |
| 2010/0282090 | A1 | 11/2010 | Etter et al. | |

FOREIGN PATENT DOCUMENTS

| | | |
|---|---|---|
| DE | 19951838 | 5/2001 |
| EP | 1024680 | 8/2000 |
| EP | 1762169 | 3/2007 |
| WO | WO 2006/136819 | 12/2006 |
| WO | WO 2010/034488 | 4/2010 |

* cited by examiner

SAFETY ARRANGEMENT FOR AN INTEGRATED HEATER, PUMP, AND MOTOR FOR AN APPLIANCE

FIELD

Embodiments of the present invention relate to dishwashing appliances and, more particularly, to systems, methods, and apparatuses for providing a safety arrangement for an integrated heater, pump, and motor for an appliance.

BACKGROUND

Dishwashers have become an integral part of everyday household use. Consumers place dishware and other utensils onto dishwasher racks inside dishwashers for cleaning. Dishwashers typically clean the dishware with wash systems that utilize spray arms and spray jets to propel water onto the dishware to remove food particles and otherwise clean the dishware.

Since it is desirable to fully clean (and sanitize) dishware contained within the tub, wash water is often heated. As such, some dishwashers include a heating element to heat the wash water, prior to circulation thereof and/or as the water is circulated to wash or rinse the dishware. The heating element may often be provided in the form of a tubular resistance heating element located near the bottom of the tub.

Such heating elements, however, present a number of deficiencies that are less than desirable. For example, a tubular resistance heating element is typically positioned within the tub near the sump (e.g., the bottom of the tub), which occupies valuable space that could otherwise be used for storage of dishware for cleaning. Another issue with such a heating element is general inefficiency in heating the wash water. For example, the heating element has a limited surface area that is exposed to the volume of water flowing, which makes proper heating of the water difficult. Thus, such heating elements have a high thermal mass and a large heat storage capacity. Such inefficiencies in heating the water further lead to slow response of the heater and unequal distribution of the heat. Moreover, the heating element is disposed generally within the dishwasher so as to heat the water prior to the circulation pump receiving the heated water and circulating it through the dishware. In such instances, the heated water may lose some thermal energy prior to being circulated.

To maximum space within the tub and provide efficient heating, circulation assemblies with an integrated heater, pump, and motor have been developed. These circulation assemblies may be positioned outside of the tub, thereby increasing storage capacity within the tub for dishware. However, integrating the heater with a circulation pump and motor creates a number of potentially hazardous conditions. Additionally, placing the integrated heater, pump, and motor directly below the dishwasher tub also creates potentially hazardous conditions.

SUMMARY OF THE INVENTION

As noted above, appliances that utilize a circulation pump assembly with integrated heater, pump, and motor may encounter a number of potentially hazardous conditions. Such hazardous conditions may be due to the integrated nature (e.g., close proximity) of the heater, circulation pump, and motor, as well as the positioning of the integrated heater, pump, and motor below the dishwasher tub. Some possible hazardous conditions include liquid spillage from the dishwasher tub, which may lead to a shock hazard with the motor and/or heater, and ejection of molten particles from a shorted motor, which may lead to a fire hazard. Additional hazardous conditions may include a potential for physical damage to the heater, circulation pump, or motor.

As such, to protect the integrated circulation pump assembly from one or more potential hazardous conditions, embodiments of the present invention provide a safety arrangement for the circulation pump assembly. Such a safety arrangement may be configured to at least partially surround the heater, circulation pump, and/or motor.

In an exemplary embodiment, a safety arrangement for a circulation pump assembly for an appliance is provided. The circulation pump assembly comprises a heater, a pump, and a motor integrated into a single unit. The circulation pump assembly comprises a first end, a second opposite end, and a housing extending therebetween. The safety arrangement comprises a hub configured to at least partially surround the first end of the circulation pump assembly. The safety arrangement further comprises a first shield configured to at least partially surround the housing of the circulation pump assembly and a second shield configured to at least partially surround the housing of the circulation pump assembly. The hub, the first shield, and the second shield are configured to cooperate with one another to protect the circulation pump assembly from one or more hazardous conditions during operation of the appliance. In some embodiments, the one or more hazardous conditions may comprise liquid spillage, ejection of molten particles, fire hazard, shock hazard, and/or physical damage. In some embodiments, the hub, the first shield, and the second shield may cooperate with one another to at least partially cover the heater, the pump, and the motor.

In some embodiments, the hub is an annular member having an opening configured to receive an inlet of the pump at the first end. Additionally, an outlet of the circulation pump assembly may extend from the housing and the first and second shields may extend around the outlet. The hub may be configured to at least partially prevent ejection of molten particles from the heater of the circulation pump assembly. Additionally, in some embodiments, the hub may comprise a temperature resistant material and/or flame retardant material. According to one aspect, the hub may define an upper surface and a lower surface. The first shield may be configured to cover the upper surface of the hub and the second shield may be configured to cover the lower surface of the hub.

In some embodiments, the heater may be disposed at the first end and the motor may be disposed at the second end. The first and second shields may extend between the first and second ends. The housing may define a radial outer surface and the first and second shields may cooperate to define a cylindrical member configured to conform to the radial surface. According to one embodiment, the first shield and second shield may be integrally formed.

Additionally, in some embodiments, the first shield may define at least one sloped surface configured to shed the water away from the circulation pump assembly. Additionally or alternatively, in some embodiments, the first shield may be configured to protect the first end of the circulation pump assembly from liquid ingress caused by water leaking from the appliance. The first shield may be configured to surround an upper surface of the housing and/or motor, and the second shield may be configured to surround a lower surface of the housing and/or motor. In one embodiment, the first shield may be configured to protect the circulation pump assembly from any water leaking from the appliance.

According to an additional aspect, the second shield may be configured to at least partially prevent ejection of molten particles from the heater of the circulation pump assembly. Additionally, in some embodiments, the second shield may comprise a temperature resistant material and/or flame retardant material.

In another embodiment, a circulation pump system for an appliance is provided. The system comprises a circulation pump assembly defining an inlet for receiving water and an outlet. The circulation pump assembly comprises a first end, a second opposite end, and a housing extending therebetween. The circulation pump assembly further comprises a heater configured to heat water within the circulation pump assembly, a pump configured to pump water through the outlet, and a motor configured to drive the pump. The heater, pump, and motor are integrated into a single unit. The assembly further comprises a safety arrangement comprising a hub, a first shield, and a second shield. The hub is configured to at least partially surround the first end of the circulation pump assembly. The first shield is configured to at least partially surround the housing of the circulation pump assembly. The second shield is configured to at least partially surround the housing of the circulation pump assembly. The hub, the first shield, and the second shield are configured to cooperate with one another to protect the circulation pump assembly from one or more hazardous conditions during operation of the appliance. In some embodiments, the one or more hazardous conditions may comprise at least one of liquid spillage, ejection of molten particles, fire hazard, shock hazard, or physical damage.

In some embodiments, the heater may be disposed at the first end and the motor may be disposed at the second end. The first and second shields may extend between the first and second ends. In some embodiments, the hub, the first shield, and the second shield may cooperate with one another to at least partially cover the heater, the pump, and the motor. The hub may define an upper surface and a lower surface. The first shield may be configured to cover the upper surface of the hub and the second shield may be configured to cover the lower surface of the hub.

In yet another embodiment, a method for assembling a circulation pump system for an appliance is provided. The method of assembly comprises providing a circulation pump assembly defining an inlet for receiving water and an outlet. The circulation pump assembly comprises a first end, a second opposite end, and a housing extending therebetween. The circulation pump assembly further comprises a heater configured to heat water within the circulation pump assembly, a pump configured to pump water through the outlet, and a motor configured to drive the pump. The heater, pump, and motor are integrated to define a single unit. The method of assembly further comprises attaching a hub to the circulation pump assembly so as to at least partially surround the housing of the circulation pump assembly. The method of assembly further comprises attaching a first shield to the circulation pump assembly so as to at least partially surround the housing of the circulation pump assembly. The method of assembly further comprises attaching a second shield to the circulation pump assembly so as to at least partially surround the housing of the circulation pump assembly. The hub, the first shield, and the second shield are configured to cooperate with one another to protect the circulation pump assembly from one or more hazardous conditions.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4:
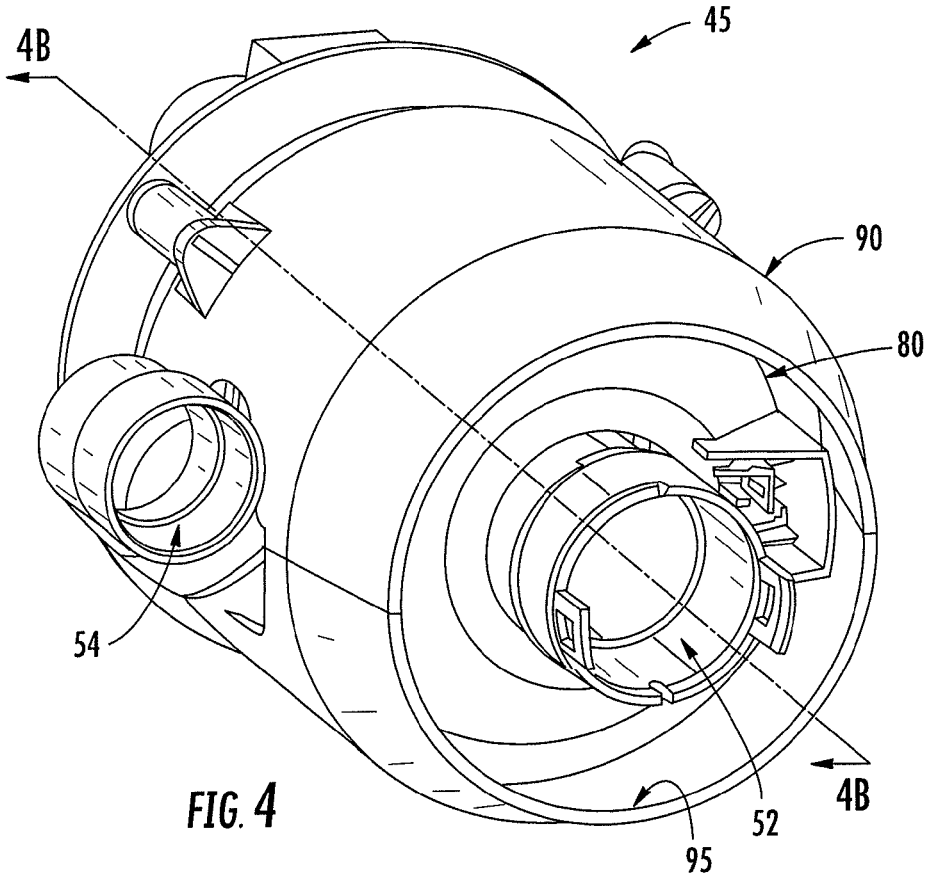
FIG. 4 is a perspective view of the circulation pump assembly shown in FIG. 2 and a safety arrangement, wherein the safety arrangement includes the hub shown in FIG. 3 and a first shield and a second shield at least partially surrounding the housing of the circulation pump assembly, in accordance with some embodiments discussed herein.
Figure 4A:
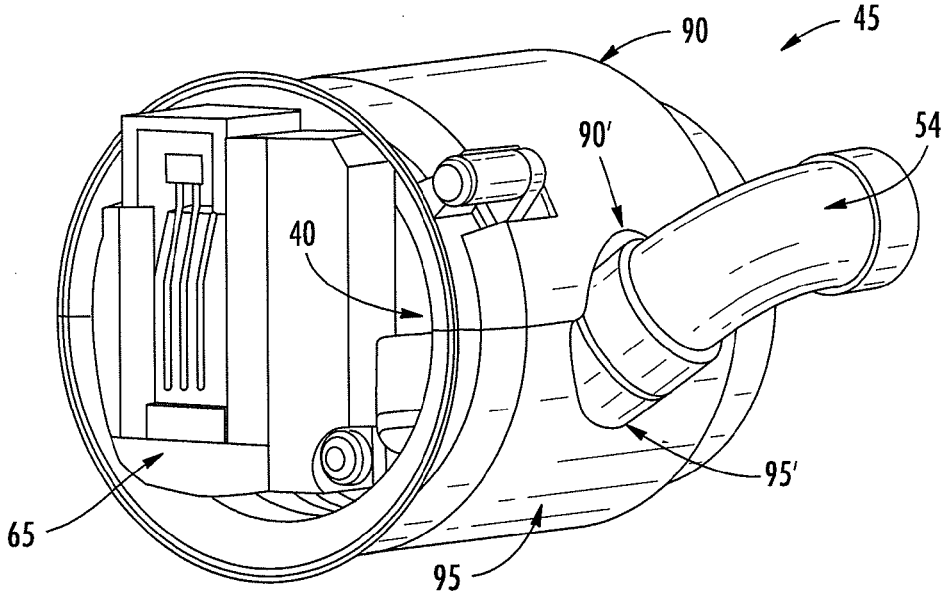
FIG. 4A is a rear perspective view of the circulation pump assembly and safety arrangement shown in FIG. 4, in accordance with some embodiments discussed herein.
Figure 4B:
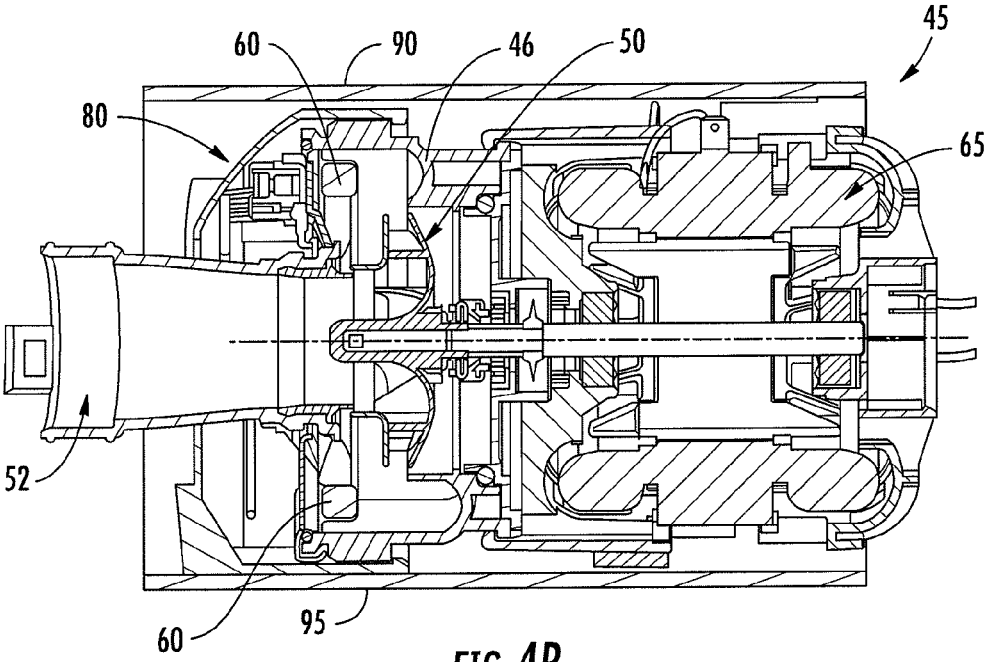
Figure 5:
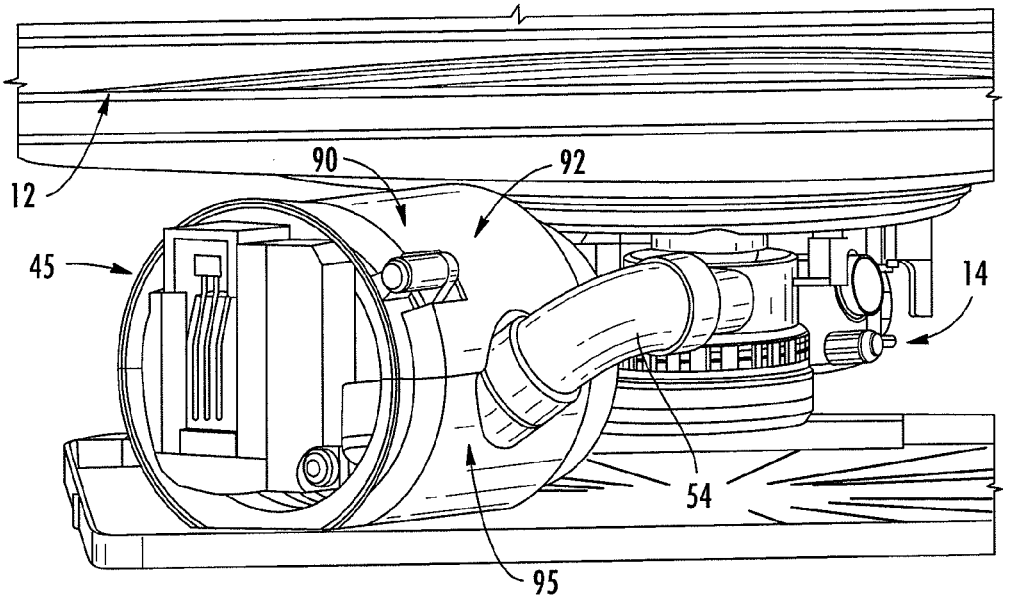

FIG. 4B is a cross-sectional view of the circulation pump assembly and safety arrangement shown in FIG. 4, taken along line 4B, in accordance with some embodiments discussed herein; and FIG. 5 illustrates the circulation pump assembly and safety arrangement shown in FIG. 4 disposed below the tub of a dishwasher and engaged with the sump of the dishwasher, in accordance with some embodiments discussed herein.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
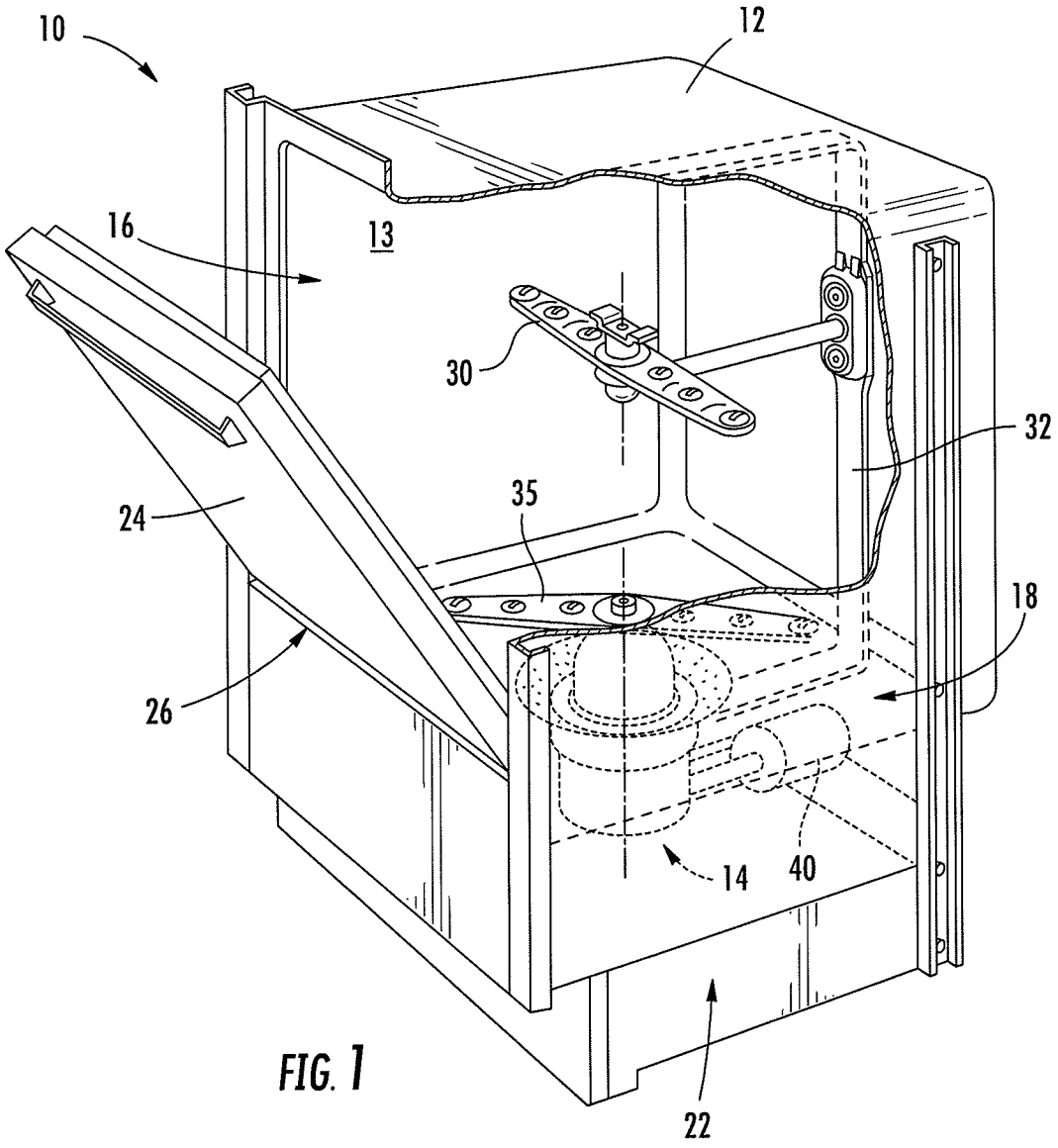
FIG. 1 is a perspective view of a dishwasher, in accordance with some embodiments discussed herein.

FIG. 1 illustrates one example of a dishwasher 10 capable of implementing various embodiments of the present invention. Such a dishwasher 10 typically includes a tub 12 (partly broken away in FIG. 1 to show internal details), having a plurality of walls (e.g., side wall 13 and bottom wall 18) for forming an enclosure in which dishes, utensils, and other dishware may be placed for washing. A door 24 may be pivotably engaged (e.g., about a hinge 26) with the tub 12 to selectively permit access to the interior of the tub 12. For example, the door 24 may comprise an open configuration and a closed configuration, such that the door 24 may at least substantially seal the forward access opening 16 of the tub 12 in the closed configuration.

The tub 12 may include a sump 14 in which wash water or rinse water is collected, typically under the influence of gravity. The wash/rinse water may be pumped by a circulation pump (e.g., circulation pump 50 (shown in FIG. 2A) within circulation pump assembly 40) to one or more spray arms (e.g., lower spray arm 35, middle spray arm 30) mounted in the interior of the tub 12 for spraying the wash/rinse water, under pressure, onto the dishes, utensils, and other dishware contained therein. For example, the circulation pump may be configured to pump wash water through a circulation conduit 32 to the middle spray arm 30 for spraying into the tub 12, such as through one or more spray jets located on the middle spray arm 30.

The dishwasher 10 may also include at least one dishwasher rack (not shown) for holding the dishes, utensils, and dishware. The dishwasher rack can be positioned within the tub 12 to hold dishware for cleaning, such as through wash water that is sprayed onto the dishware from the spray arms and/or spray jets.

In order to avoid the deficiencies of some heating elements, dishwashers may employ a circulation pump assembly with a heater, pump, and motor integrated into a single unit. Such an integrated circulation pump assembly may be positioned below the tub of the dishwasher (e.g., within the base 22) to conserve storage space within the dishwasher tub that would otherwise be occupied by the above mentioned heating element. Additionally, positioning the heater closer to the circulation pump decreases any heat and energy loss that may occur in the wash water prior to circulation through the dishwasher.

Figure 2:
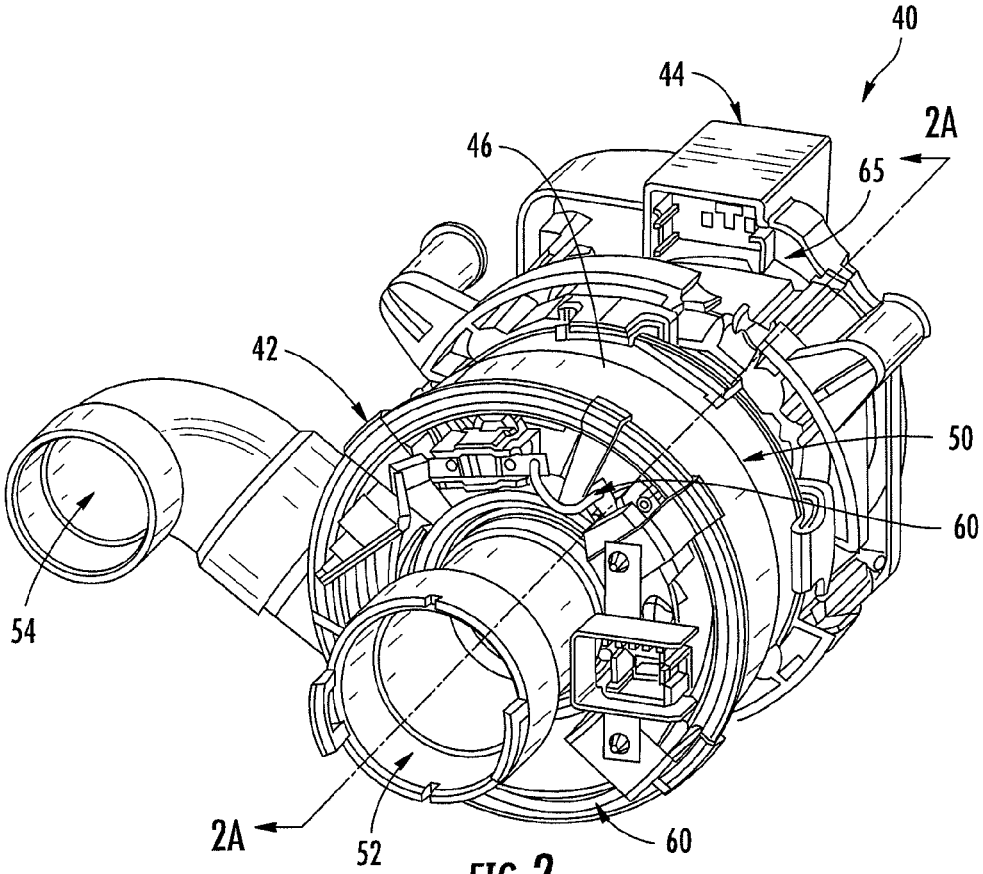
FIG. 2 is a perspective view of a circulation pump assembly with an integrated heater, pump, and motor, in accordance with some embodiments discussed herein.
Figure 2A:
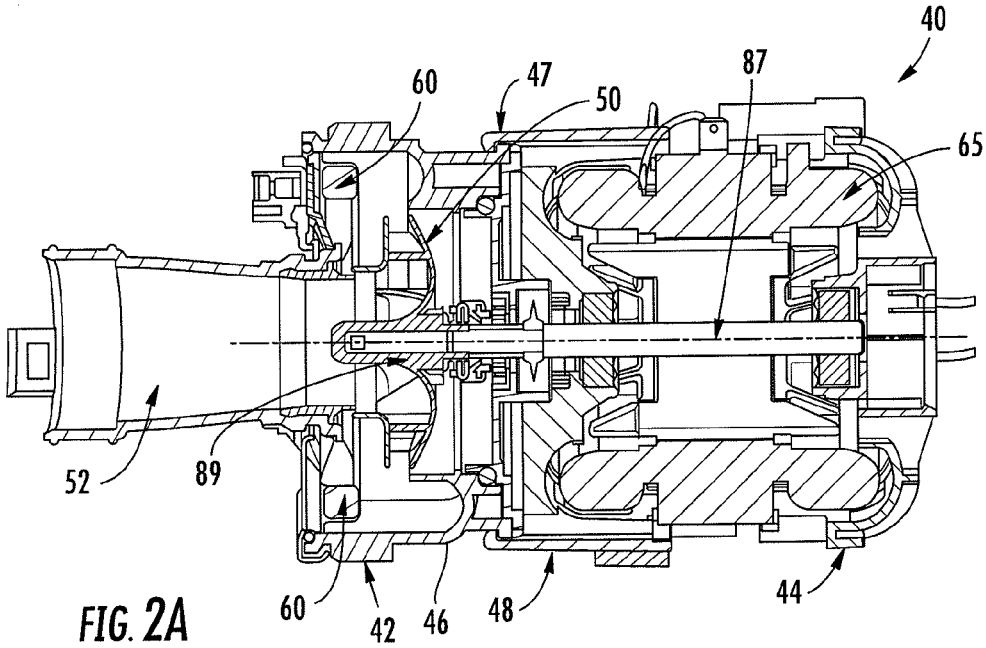
FIG. 2A is a cross-sectional view of the circulation pump assembly shown in FIG. 2 taken along line 2A, in accordance with some embodiments discussed herein.

FIG. 2 illustrates a circulation pump assembly 40 used in some embodiments of the present invention. In the depicted embodiment and with further reference to FIG. 2A, the circulation pump assembly 40 comprises a heater 60, circulation pump 50, and motor 65 integrated into a single unit. The circulation pump assembly 40 may comprise a first end 42, a second opposing end 44, and a housing 46 extending at least partially therebetween.

The circulation pump 50, as noted above, may be used for circulating (e.g., pumping) water in a household appliance, such as a dishwasher. The circulation pump 50 includes an inlet 52 for receiving wash water, such as from the sump 14, and an outlet 54 for directing (and/or pumping) wash water through the circulation system (e.g., circulation conduit 32 and spray arms 30 and 35) into the dishwasher tub 12.

The motor 65 may be positioned at the second end 44 of the circulation pump assembly 40. The motor 65 is configured to activate and drive pumping of the wash water through the circulation pump 50, such as by driving rotation of a drive shaft 87 coupled to an impeller 89 of the circulation pump 50.

The heater 60 may be disposed at the first end 42 of the circulation pump assembly 40 proximate the circulation pump 50. The heater 60 may comprise a tubular heater that extends within an annular groove defined within an end cap proximate the circulation pump 50. In the depicted embodiment, the heater 60 has a rectangular cross section and is positioned within a corresponding depression or recess within the end cap such that water may flow around the heater 60. In some embodiments, the material forming the connection between the heater 60 and the circulation pump 50 may comprise a heat-conducting material such that the heater 60 conducts heat through the material in order to heat water flowing thereby.

The housing 46 may extend or otherwise be positioned between the first end 42 and the second end 44 of the circulation pump assembly 40. In one embodiment, the housing is associated with the circulation pump 50 and is configured to direct water from the inlet 52 to the outlet 54 as well as house the impeller 89 therein. The housing 46 may also be configured to connect and integrate the heater 60, pump 50, and motor 65 into a single unit. For example, the housing 46 may be configured to connect to the end cap (including the heater 60) at one end and to the motor 65 at the opposite end. In the depicted embodiment, the housing 46 defines a radial outer surface. In some embodiments, the housing 46 defines an upper surface 47 and lower surface 48.

An exemplary circulation pump assembly with integrated heater, pump, and motor is a brushless DC motor with a tubular heater. Examples of circulation pump assemblies with an integrated heater, pump, and motor, as well as greater detail regarding each of their components, can be found in U.S. Pat. Nos. 7,455,065 and 7,293,958, which are hereby incorporated by reference in their entireties.

With reference to FIG. 1, embodiments of the present invention may provide a circulation pump assembly 40 with an integrated heater, pump, and motor that is externally mounted from the tub 12 of the dishwasher 10, such as in the base 22 of the dishwasher 10.

Externally mounting an integrated heater 60, circulation pump 50, and motor 65 below the tub 12, however, may present some design challenges concerning space and safety. In particular, mounting a circulation pump assembly (e.g., circulation pump assembly 40) below the tub of the dishwasher presents the potential for one or more hazardous conditions to occur. One such hazardous condition is possible physical damage to one or more of the components. For example, the close proximity of the other components of the dishwasher 12 presents significant risk of a thermal event, such as melting of plastic components. Additionally, other possible hazardous conditions include ejection of molten particles from a shorted motor and/or shorted heater filament, which may cause a fire hazard for nearby components (e.g., plastic components of the dishwasher contained in or near the base 22). Additional hazardous conditions include liquid spillage and shock hazard, such as may occur if water leaks from the sump 14 or the tub 12 onto the heater 60 potentially causing damage and creating a shock hazard. As such, mounting a circulation pump assembly with an integrated heater, pump, and motor below the tub of a dishwasher may create at least one of the following hazardous conditions: liquid spillage, ejection of molten particles, fire hazard, shock hazard, or physical damage.

To protect the appliance from one or more of the hazardous conditions, some embodiments of the present invention provide a safety arrangement for the circulation pump assembly. In one embodiment, the safety arrangement enables the circulation pump assembly with integrated heater, pump, and motor to be safely mounted underneath the tub of the dishwasher.

According to one embodiment, FIGS. 4-4B illustrate a safety arrangement for a circulation pump assembly for an appliance. The safety arrangement may comprise a hub 80, a first shield 90, and a second shield 95. Though the safety arrangement is depicted with a hub, first shield, and second shield in FIG. 4, embodiments of the present invention may include a safety arrangement with only one of the hub, first shield, or second shield. Likewise, embodiments of the present invention may include a safety arrangement with any combination of the hub, first shield, or second shield.

Figure 3:
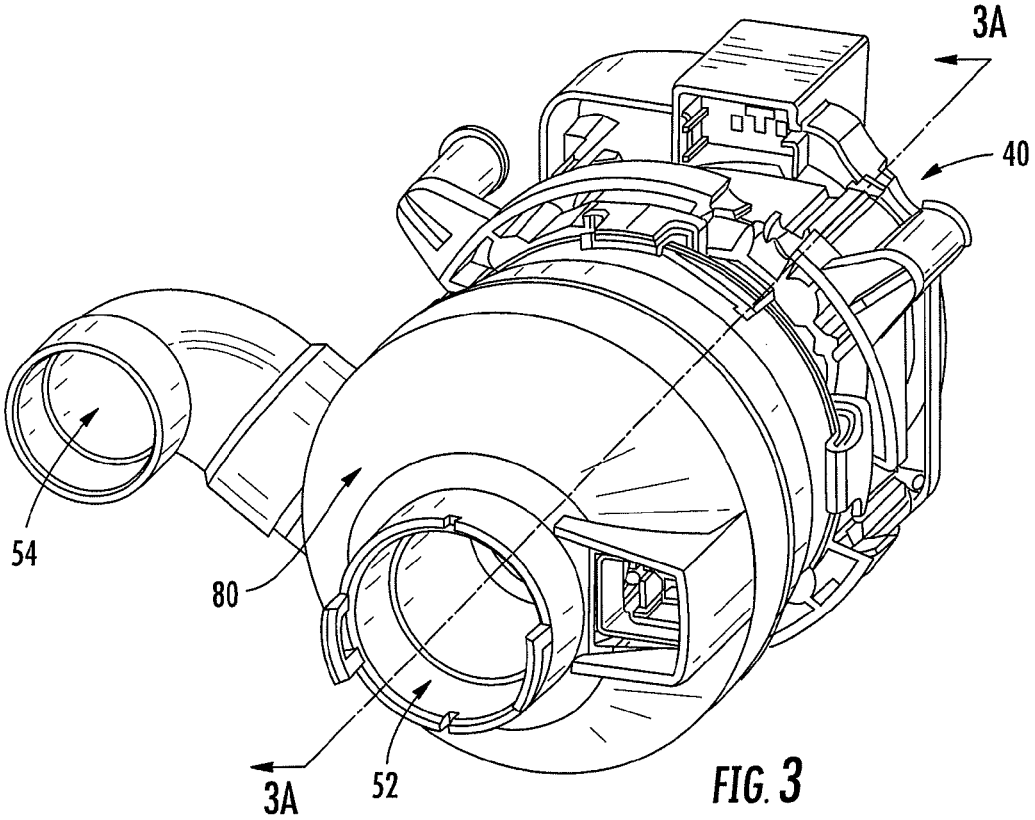
FIG. 3 is a perspective view of the circulation pump assembly shown in FIG. 2 with a hub at least partially surrounding a first end of the circulation pump assembly, in accordance with some embodiments discussed herein.
Figure 3A:
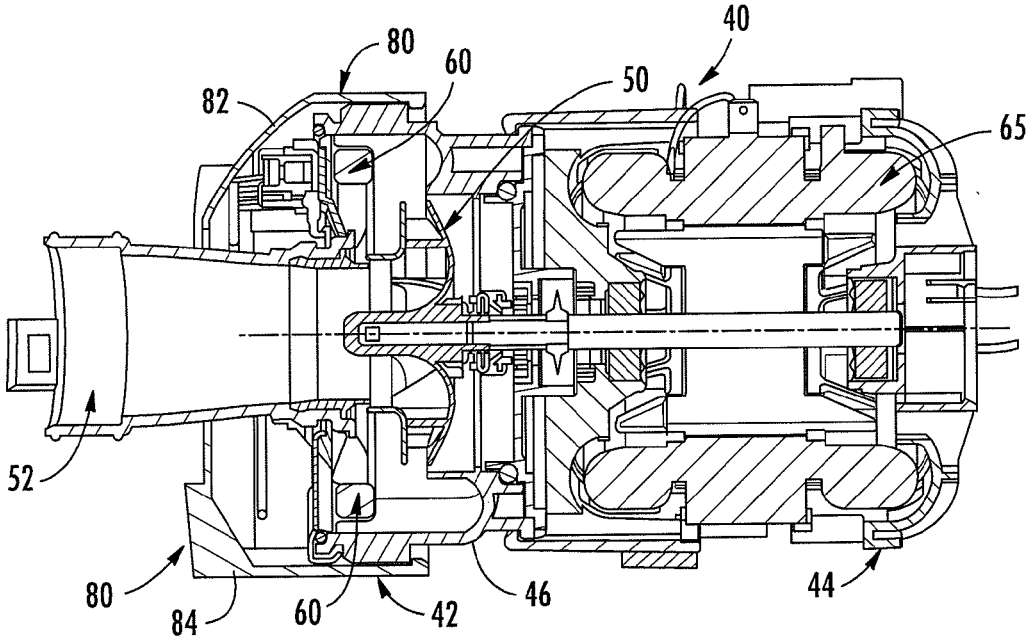
FIG. 3A is a cross-sectional view of the circulation pump assembly and hub shown in FIG. 3 taken along line 3A, in accordance with some embodiments discussed herein.

The hub 80 may be configured to at least partially surround the first end of the circulation pump assembly. For example, with reference to FIG. 3, the hub 80 at least partially surrounds the first end 42 of the circulation pump assembly 40. In the depicted embodiment, the hub 80 covers the heater 60, a portion of the circulation pump 50, and at least a portion of the housing 46. Additionally, in the depicted embodiment, the hub 80 is an annular member having an opening configured to receive the inlet 52.

In some embodiments, the hub 80 may be made of temperature resistant and/or flame-retardant material. For example, the hub 80 may be a polymer material (e.g., 5VA rated material) or a metal material. The hub 80 may be configured to protect the heater 60 from physical damage, such as during shipping, assembly, and operation. The hub 80 may also be configured to at least partially surround the heater 60 of the circulation pump assembly 40 to act as a barrier, preventing potential ejection of molten particles. Moreover, the hub 80 may be configured to direct water that leaks from the sump 14 or tub 12 away from the heater 60. In such a manner, the hub 80 may be configured to protect the circulation pump assembly 40 from one or more hazardous conditions.

The first shield 90 may be configured to extend at least partially between the first 42 and second 44 ends. In one embodiment, the first shield 90 is configured to at least partially surround the housing 46 of the circulation pump assembly 40. In some embodiments, the first shield 90 may be configured to surround the upper surface 47 of the housing 46 and extend at least partially between the first end 42 and the second end 44 of the circulation pump assembly 40. For example, FIG. 4 illustrates that the first shield 90 may be configured to surround the upper surface 47 of the housing 46. In addition, the hub 80 may comprise an upper surface 82. In such embodiments, the first shield 90 may be configured to surround and/or cover the upper surface 47 of the housing 46 and/or the upper surface 82 of the hub 80. In some embodiments, the first shield 90 may also be configured to at least partially extend around the upper surface of the motor 65 and/or the back side of the motor. For example, the first shield 90 may extend around a protective covering (e.g., cowl or end cap) of the motor 65.

In some embodiments, the first shield 90 may be configured to protect the circulation pump assembly 40 and/or hub 80 from water leakage from the sump 14 or tub 12. For example, the first shield 90 may have at least one radial or sloped surface 92 (shown in FIG. 5) designed to shed water away from the circulation pump assembly 40 and/or hub 80. Likewise, the first shield 90 may be configured to protect the first end 42 of the circulation pump assembly 40 from liquid ingress caused by water leaking from the appliance (e.g., tub 12 or sump 14). Additionally, in some embodiments, the first shield 90 may be made of temperature resistant and/or flame-retardant material (e.g., 5VA material). In other embodiments, the first shield 90 may be made of a suitable plastic (e.g., V0 rated material) or a metal material meeting the desired safety standards. In such a manner, the first shield 90 may be configured to protect the circulation pump assembly 40 from one or more hazardous conditions.

The second shield 95 may also be configured to extend at least partially between the first 42 and second 44 ends. In one embodiment, the second shield 95 at least partially surrounds the housing 46 of the circulation pump assembly 40. In some embodiments, the second shield 95 may be configured to surround the lower surface 48 of the housing 46 and extend at least partially between from the first end 42 and the second end 44 of the circulation pump assembly 40. For example, FIG. 4 illustrates that the second shield 95 may be configured to surround the lower surface 48 of the housing 46. In addition, the hub 80 may comprise a lower surface 84. In such embodiments, the second shield 95 may be configured to surround and/or cover the bottom surface 48 of the housing 46 and/or the lower surface 84 of the hub 80. In one embodiment, the second shield 95 may also be configured to at least partially extend around the upper surface of the motor 65 and/or the back side of the motor, such as around a protective covering (e.g., cowl or end cap) of the motor 65.

In some embodiments, the second shield 95 may be configured as a fire barrier to protect against potential ejection of molten particles from a shorted motor. For example, the second shield 95 may be configured to at least partially prevent ejection of molten particles from the heater 60 of the circulation pump assembly 40. As such, in some embodiments, the second shield 95 may be made of temperature resistant and/or flame-retardant material (e.g., 5VA or V0 rated material). In other embodiments, the second shield 95 may be made of a suitable plastic or metal material having the desired safety standards. In such a manner, the second shield 95 may be configured to protect the circulation pump assembly 40 from one or more hazardous conditions.

In the depicted embodiments, the housing 46 and the circulation pump assembly 40 may generally define a radial outer surface. As such, in some embodiments, the first shield 90 may define a radial surface configured to conform to at least a portion of the housing 46 (e.g., the upper surface 47) and circulation pump assembly 40. Likewise, in some embodiments, the second shield 95 may define a radial surface configured to conform to at least a portion of the housing 46 (e.g., the lower surface 48) and circulation pump assembly 40. In such embodiments, the first and second shields 90, 95 may cooperate to define a cylindrical member configured to conform to the radial surfaces of the housing 46 and circulation pump assembly 40.

In some embodiments, the circulation pump assembly 40 and/or housing 46 may define an outlet 54 that extends outwardly therefrom. For example, with reference to FIGS. 4-4B, the outlet 54 extends radially outward and forward from the circulation pump assembly 40. In such embodiments, the first shield 90 may define a recess 90' configured to conform to an upper portion of the outlet 54. Likewise, the second shield 95 may define a recess 95' configured to conform to a lower portion the outlet 54. As such, the recesses 90', 95' may cooperate with one another to define an opening that is configured to receive the outlet 54 therethrough.

Though shown in the depicted embodiments as separate elements, in some embodiments, the first and second shields 90, 95 may be coupled together. In an alternative embodiment, the first and second shields 90, 95 may be integrally formed.

As is consistent with the described safety features of each of the hub 80, first shield 90, and second shield 95, with reference to FIGS. 4-4B, in some embodiments, the hub 80, first shield 90, and second shield 95 may be configured to cooperate with one another to protect the circulation pump assembly 40 from one or more hazardous conditions. Additionally, in some embodiments, the hub 80, first shield 90, and second shield 95 may cooperate with one another to at least partially cover the heater 60, pump 50, and motor 65. In some embodiments, the safety arrangement and/or the components of the safety arrangement (e.g., the first shield 90, second shield 95, and/or hub 80) may be configured to comply with safety standards, such as preventing clearance for fingers of a user to enter the circulation pump assembly so as to prevent a shock hazard to the user.

As noted above, in some embodiments, the circulation pump assembly 40 with heater 60, pump 50, and motor 65, may be configured to connect to the sump 14 and be positioned below the tub 12 and in the base 22 of the dishwasher 10. As such, in order to protect the circulation pump assembly 40 from one or more hazardous conditions, a safety arrangement (e.g., any embodiment of a safety arrangement described herein) may be attached to and/or at least partially cover the circulation pump assembly 40. Thus, with reference to FIG. 5, a circulation pump system 45 with a safety arrangement and a circulation pump assembly 40 may be positioned within the base 22 of the dishwasher 10. In the depicted embodiment, the inlet 52 (not shown) and outlet 54 of the circulation pump assembly 40 is fluidly connected to the sump 14 for directing water into and out of the circulation pump assembly 40, respectively.

Some embodiments of the present invention provide a method of assembling any such embodiments of the safety arrangement and circulation pump assembly described herein. In one embodiment, a method of assembling a safety arrangement and a circulation pump assembly for an appliance (e.g., dishwasher) is provided. With reference to FIGS. 1-5, the method includes providing a circulation pump assembly 40, as described above.

The method of assembly further comprises attaching a hub 80 to the circulation pump assembly 40 so as to at least partially surround the housing 46 of the circulation pump assembly 40. The method of assembly further comprises attaching a first shield 90 to the circulation pump assembly 40 so as to at least partially surround the housing 46. The method of assembly further comprises attaching a second shield 95 to the circulation pump assembly 40 so as to at least partially surround the housing 46. The hub 80, the first shield 90, and the second shield 95 are configured to cooperate with one another to protect the circulation pump assembly 40 from one or more hazardous conditions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A dishwasher comprising:

a tub configured to hold dishes to be washed;

a sump connected to a lower end of the tub;

a circulation pump assembly disposed below the tub, wherein the circulation pump assembly is fluidly connected to the sump, wherein the circulation pump assembly comprises:

a heater, a pump, and a motor integrated into a single unit configured to circulate and heat wash liquid within the dishwasher, wherein the circulation pump assembly comprises a first end, a second opposite end, and a housing extending therebetween such that the housing surrounds the heater, the pump, and at least a portion of the motor, wherein the first end and the second end define an axis spanning therebetween, a safety arrangement comprising:

a hub configured to at least partially surround the first end of the circulation pump assembly, wherein the hub is an annular member configured to cover at least a portion of the housing proximate the first end of the circulation pump assembly, wherein the hub defines an opening, wherein the hub is configured to receive an inlet of the pump through the opening at the first end;

a first shield positioned adjacent to a first surface of the housing of the circulation pump assembly and configured to at least partially surround the first surface of the housing of the circulation pump assembly;

a second shield positioned adjacent to a second surface of the housing of the circulation pump assembly and configured to at least partially surround the second surface of the housing of the circulation pump assembly; and a seam extending between the first shield and the second shield, wherein the seam extends at least from the first end to the second end, wherein the hub, the first shield, and the second shield are configured to cooperate with one another to protect the circulation pump assembly during operation of the dishwasher, wherein an outlet of the circulation pump assembly extends radially outward from the housing, relative to the axis, through at least one of the first shield and the second shield.

2. The dishwasher according to claim 1, wherein the heater is disposed at the first end and the motor is disposed at the second end, and wherein the first and second shields extend between the first and second ends.

3. The dishwasher according to claim 1, wherein the hub, the first shield, and the second shield cooperate with one another to at least partially cover the heater, the pump, and, the motor.

4. The dishwasher according to claim 1, wherein the housing has a radial outer surface, and wherein the first and second shields cooperate to define a cylindrical member configured to conform to the radial surface.

5. The dishwasher according to claim 1, wherein the first shield defines a first recess configured to conform to an upper portion of the outlet, wherein the second shield defines a second recess configured to conform to a lower portion of the outlet, and wherein the outlet of the circulation pump assembly extends radially outward from the housing through the first shield and the second, shield.

6. The dishwasher according to claim 1, wherein the hub defines an upper surface and a lower surface, wherein the first shield is configured to cover the upper surface of the hub, and wherein the second shield is configured to cover the lower surface of the hub.

7. The dishwasher according to claim 6, wherein the first shield has at least one sloped surface configured to shed water away from the circulation pump assembly.

8. The dishwasher according to claim 6, wherein the first shield is configured to protect the first end of the circulation pump assembly from liquid ingress caused by water leaking from the appliance.

9. The dishwasher according to claim 6, wherein the second shield is configured to at least partially prevent ejection of molten particles from the heater of the circulation pump assembly.

10. The dishwasher according to claim 9, wherein the second shield comprises at least one of temperature resistant material or flame retardant material.

11. The dishwasher according to claim 1, wherein the hub is configured to at least partially prevent ejection of molten particles from the heater of the circulation pump assembly.

12. The dishwasher according to claim 11, wherein the hub comprises at least one of temperature resistant material or flame retardant material.

13. The dishwasher according to claim 1, wherein the first shield is configured to protect the circulation pump assembly from any water leaking from the appliance.

14. The dishwasher of claim 1, wherein the first shield and second shield are integrally formed.

15. The dishwasher according to claim 1, wherein the first shield has at least one sloped surface configured to shed water away from the circulation pump assembly and the second shield comprises at least one of temperature resistant material or flame retardant material and is configured to at least partially prevent ejection of molten particles from the heater of the circulation pump assembly.

16. The dishwasher according to claim 1, wherein the outlet of the circulation pump assembly extends perpendicular to the axis through the at least one of the first shield and the second shield.

17. A method of assembling a circulation pump system in a dishwasher, wherein the circulation pump system is configured to circulate and heat wash liquid within the appliance, the method comprising:

providing a dishwasher comprising:

a tub configured to hold dishes to be washed;

a sump connected to a lower end of the tub;

disposing a circulation pump assembly in the dishwasher below the tub, wherein the circulation pump assembly is fluidly connected to the sump, wherein the circulation pump assembly defines an inlet for receiving water and an outlet, wherein the circulation pump assembly comprises a first end, a second opposite end, and a housing extending therebetween, wherein the first end and the second end define an axis spanning therebetween, the circulation pump assembly comprising:

a heater configured to heat water within the circulation pump assembly;

a pump configured to pump water through the outlet; and a motor configured to drive the pump, wherein the heater, pump, and motor are integrated to define a single unit, wherein the housing surrounds the heater, the pump, and at least a portion of the motor;

attaching a hub to the circulation pump assembly so as to at least partially surround the housing of the circulation pump assembly, wherein the hub is an annular member configured to cover at least a portion of the housing proximate the first end of the circulation pump assembly, wherein the hub defines an opening, wherein the hub is configured to receive an inlet of the pump through the opening at the first end;

attaching a first shield adjacent to a first surface of the housing of the circulation pump assembly so as to at least partially surround the first surface of the housing of the circulation pump assembly; and attaching a second shield adjacent to a second surface of the housing of the circulation pump assembly so as to at least partially surround the second surface of the housing of the circulation pump assembly, wherein the hub, the first shield, and the second shield are configured to cooperate with, one another to protect the circulation pump assembly during operation of the appliance, wherein a seam extends between the first shield and the second shield, wherein the seam extends at least from the first end to the second end, and wherein the outlet of the circulation pump assembly extends radially outward from the housing, relative to the axis, through at least one of the first shield and the second shield.

18. The method according to claim 17, wherein the first shield has at least one sloped surface configured to shed the water away from the circulation pump assembly and the second shield comprises at least one of temperature resistant material or flame retardant material and is configured to at least partially prevent ejection of molten particles from the heater of the circulation pump assembly.

* * * * *